United States Patent [19]

Bostonian

[11] 4,277,820

[45] Jul. 7, 1981

[54] METHOD AND APPARATUS FOR CONVERTING A CEILING LIGHT FIXTURE HAVING A PLURALITY OF FLUORESCENT LAMPS INTO A SINGLE LAMP, OR TWO LAMP, FIXTURE

[76] Inventor: Edward T. Bostonian, 330 Christine St., Elizabeth, N.J. 07202

[21] Appl. No.: 27,076

[22] Filed: Apr. 4, 1979

[51] Int. Cl.[3] ..... F21V 13/04

[52] U.S. Cl. ..... 362/223; 362/235; 362/260; 362/308

[58] Field of Search ..... 362/217, 222, 223, 224, 362/225, 232, 235, 254, 260, 285, 307, 308, 311, 326, 327, 328, 330, 339, 218, 219, 220, 221

[56] References Cited

U.S. PATENT DOCUMENTS

| | | | |
|---|---|---|---|
| 2,694,775 | 11/1954 | Florence | 362/222 |
| 3,009,055 | 11/1961 | Franzese | 362/217 |
| 3,025,391 | 3/1962 | Golko | 362/221 |
| 3,090,434 | 5/1963 | Benson et al. | 362/218 |
| 3,209,142 | 9/1965 | Michel et al. | 362/218 |
| 3,270,194 | 8/1966 | Puikum | 362/218 |
| 3,760,178 | 9/1973 | Miller | 362/223 |
| 3,810,085 | 5/1974 | Woloski | 362/277 |
| 4,025,780 | 5/1977 | Krase et al. | 362/221 |
| 4,138,716 | 2/1979 | Muhlethaler et al. | 362/260 |
| 4,161,019 | 7/1979 | Mulvey | 362/260 |

*Primary Examiner*—L. T. Hix
*Assistant Examiner*—Alan Mathews
*Attorney, Agent, or Firm*—Hane, Roberts, Spiecens & Cohen

[57] ABSTRACT

A replacement for a light transmitting panel of a ceiling light fixture having a plurality of replaceable fluorescent lamps for reducing the number of lamps in the fixture. The replacement includes a light transmitting part partially covering the body of the fixture for partially surrounding one or more of the fluorescent lamps for permitting light passage therefrom, and light reflectors covering the remainder of the fixture body such that at least two other fluorescent lamp can be removed and rendered inoperable in the fixture. The reflectors are operatively positioned in facing relation to the light transmitting part to reflect downwardly light transmitted thereto. A door frame is detachably engageable with the fixture body and operatively engages both the light transmitting part and the reflectors to mount the same on the fixture body.

18 Claims, 8 Drawing Figures

METHOD AND APPARATUS FOR CONVERTING A CEILING LIGHT FIXTURE HAVING A PLURALITY OF FLUORESCENT LAMPS INTO A SINGLE LAMP, OR TWO LAMP, FIXTURE

FIELD OF THE INVENTION

The invention relates to a method of converting a ceiling light fixture having a recessed fixture body and a plurality of fluorescent lamps into a single lamp or two lamp fixture.

The invention also relates to apparatus which is replaceable with a conventional light transmitting panel to permit the passage of light from one or two fluorescent lamps while convering the remainder of the opening of the fixture so that other lamps in the fixture can be rendered inoperative.

PRIOR ART

In the current period of energy conservation various attempts have been made to minimize the use of electricity for lighting purposes.

A particular effort has been devoted to the reduction of the number of lamps in overhead ceiling fixtures, particularly of the fluorescent type.

More specifically, in a ceiling fixture having a plurality of lamps, attempts have been made to eliminate two or more lamps and leave a reduced number of operating lamps in the fixture.

In order to achieve this, the conventional light transmitting panel which covers the opening of the fixture, is replaced by a unit which permits the removal of two or more lamps and allows passage of light therethrough from a reduced number of lamps.

In a conventional ceiling fixture having a plurality of replaceable fluorescent lamps, the light transmitting panel is mounted in a frame which is detachably supported in the fixture body.

In order to reduce the number of operating fluorescent lamps it is known to replace the light transmitting panel with a one-piece panel of opaque material which has an opening for receiving a light transmitting portion adapted for use with one of the lamps of the fixture. In this way, the other non-operative lamps can be removed from the fixture so that only one lamp is operative and the light therefrom will be transmitted through the new reduced light transmitting part. This latter part is supported by the replacement panel which is mounted in the door frame and the entire assembly replaces the original light transmitting part for the plurality of lamps.

SUMMARY OF THE INVENTION

An object of the invention is to provide an improved method and construction for reducing the number of operative lamps in a multi-lamp fluorescent fixture.

It has been found, in accordance with the invention, that to prevent the leakage of light between the light transmitting part and the shielding part which covers the portion of the fixture at which the non-operating lamps have been removed, it is necessary to properly support both the light transmitting part and the shielding part in the door frame.

Such support also provides for a substantially fixed relation between the light transmitting part and the shielding part during use and precludes any relative shifting thereof as could occur due to vibrations or impacts of a nature which are conventionally encountered in use.

A further object of the invention is to provide a method and construction in which the shielding part acts to reflect the light transmitted from the light transmitting part to improve the overall illumination afforded by the fixture. This is important since the light output from the fixture has been materially reduced by the elimination of two or more lamps.

In accordance with the above objects, the invention contemplates for a ceiling light fixture having a recessed, surface or stem suspended fixture body, a plurality of replaceable fluorescent lamps and a light transmitting panel detachably supported by the fixture body for covering the fixture body and lamps, the improvement comprising means replaceable for the light transmitting panel and including a light transmitting part partially covering the fixture body for partially surrounding one or more of the fluorescent lamps to permit light passage therefrom and shielding means for covering the remainder of the fixture body such that, at least one other fluorescent lamp can be removed and rendered inoperable in the fixture. In accordance with the invention, the shielding means is operatively positioned in facing relation to the light transmitting part to reflect light transmitted thereto downwardly and outwardly. The improvement further includes door frame means detachably engageable with the fixture body and operatively engaging both the light transmitting part and the shielding means to mount the same in the fixture body when the door frame means is engaged therewith.

In further accordance with the invention, the shielding means has a light reflective surface to promote the light reflection therefrom.

In accordance with a feature of the invention, the shielding means comprises two reflector sections respectively engaging the light transmitting part on opposite sides thereof. The door frame means comprises a door frame including a channel which receives the reflector sections and the light transmitting part.

It is further contemplated, according to the invention, that the light transmitting part and the reflector sections have projecting lips at their ends which engage in the door frame. These lips can be formed by projections at the ends of the light transmitting part and the reflector sections or they can be formed by providing notches therein.

The invention will next be described in conjunction with preferred embodiments thereof as illustrated in the attached drawings.

DETAILED DESCRIPTION

Figure 1:
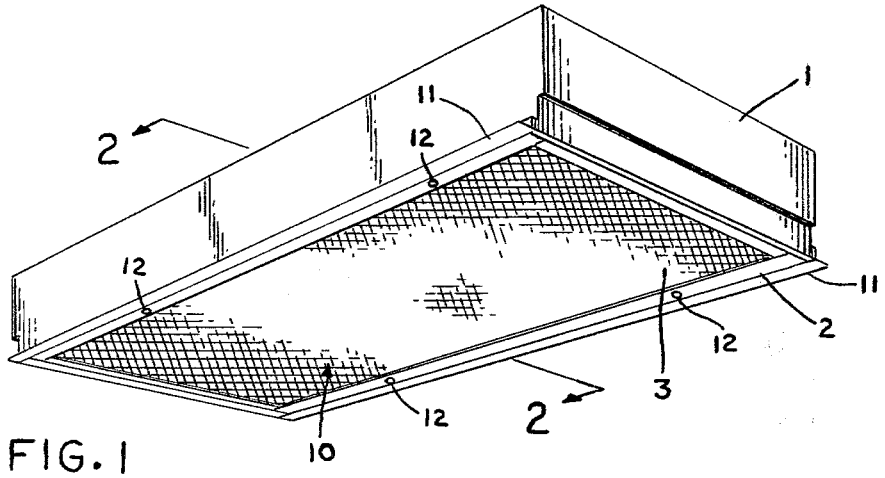
FIG. 1 PRIOR ART
FIG. 1 is a bottom perspective view of a conventional ceiling fixture having a plurality of fluorescent lamps.
Figure 2:
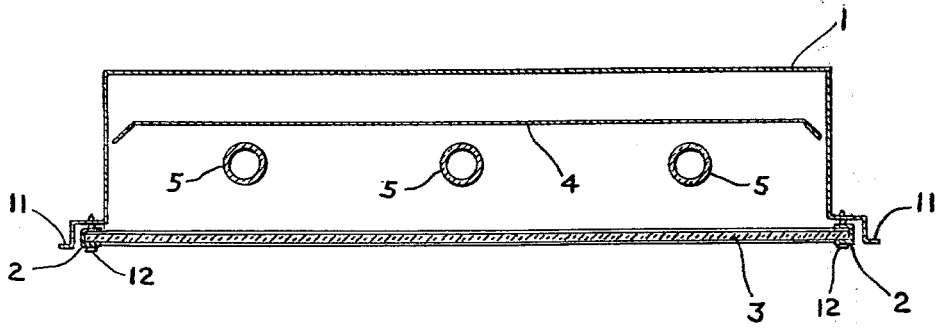
FIG. 2 PRIOR ART
FIG. 2 is a transverse sectional view of the fixture of FIG. 1.

In the conventional construction of a ceiling fixture as illustrated in FIGS. 1 and 2, it is seen that the fixture comprises a fixture body 1 adapted for being mounted in an opening in the ceiling and supporting a frame 2 which carries a light transmitting panel 3. The frame 2 and panel 3 collectively form a door 10.

The body 1 is recessed within the ceiling and bent flanges 11 on the body serve to cover the edges of the opening in the ceiling.

In other conventional constructions, the fixture body 1 can have side edges to fit into ceiling Z splines. In another modification, the fixture can be surface or pendant mounted.

The particular configuration of the fixture body and its mode of mounting in the ceiling is not relevant to the invention as will become apparent later.

The door 10 is mounted in the fixture in various ways and, for the purpose of illustration, FIG. 2 diagrammatically illustrates the provision of fasteners 12 which secure the door frame to the fixture body 1.

The support of the door frame can be made in other ways as, for example, by means of hinges on one side with screws or catches on the other side. In other known arrangements the door may simply lay on top of a return flange on the fixture body and is inserted or removed in a tilted position.

The door frame 2 is illustrated in FIG. 2 as being of a typical channel type and other variations of the door frame are known. By way of example, the door frame may have an inner bend which projects upwardly towards the fixture body to engage therein to prevent light leakage between the door and the fixture body.

In another modification, the door frame may be configured to extend within the fixture and provide a regressed door.

The door frame can also be formed as a simple angle in order to receive the light panel 3.

The nominal dimensions of the door vary between two feet and five feet in width and two feet and five feet in length.

The light transmitting panel 3 has been illustrated as of a flat configuration in FIGS. 1 and 2 and is held by the four sides of the door.

The light transmitting panel can be made in numerous different ways as conventionally employed and, for example, it may be constructed as a regressed panel or as a dished panel. It can also be constructed as a louvered panel Within the fixture body is a metal reflector 4 which also serves as a ballast cover. The reflector is essentially illustrated as a flat member, but it can be constructed in different fashion with individualized projections above each of the lamps 5 or with separate ballast covers disposed between the lamps or at the ends of the reflector. If separate ballast covers are employed, the inner surface of the fixture body 1 itself may be used as the reflecting surface, in which case the reflector 4 will be omitted.

Mounted within the fixture body 1 are a plurality of fluorescent lamps 5 extending, generally, parallel to one another and of a size which will range from two feet to eight feet in length. In the eight foot size, two doors are generally used.

Although three lamps have been illustrated in the drawing, other numbers of lamps per fixture may be employed varying, for example, from three to eight. The most common arrangement is the use of four lamps per fixture.

Figure 3:
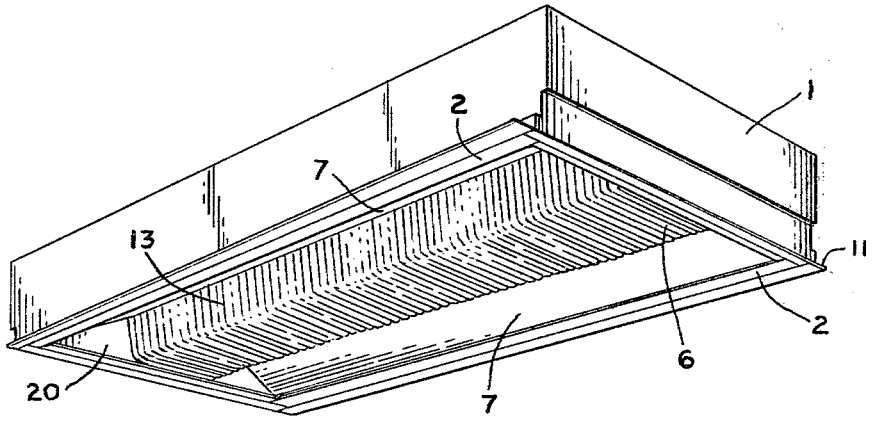
FIG. 3 is a bottom perspective view of a ceiling light fixture with the improvement according to the invention.

FIG. 3 shows the construction according to the invention wherein the ceiling fixture has been converted into a single lamp fixture in which only the central lamp 5 is operative and the end lamps have been removed and rendered inoperative.

In replacement of the door 10 of the embodiment as shown in FIGS. 1 and 2, the construction in FIG. 3 shows the use of a trough-shaped light transmitting panel 6 associated with two symmetrically arranged reflector sections 7 which serve as shielding elements for covering the remainder of the fixture body not encompassed by the light transmitting part 6.

The light transmitting part 6 has been shown to have a trough-shape, a namely, a U-shaped section with slightly inclined sides 13. It is within the contemplation of the invention that the sides of the light transmitting part can be straight, angulated, curved or of various combinations of cross-sections. The upper edge of the sides 13 can be provided with return edges to facilitate engagement with the reflector sections 7 as will become apparent later.

The light transmitting part can be constituted of a plastic material or glass.

The reflector sections 7 are located on opposite sides of the light transmitting part 6 and include bent edges 14 which engage the upper edges of the sides 13 of the light transmitting part 6 in order to eliminate any loss of light transmission. Additionally, the bent edge 14 permits positioning of the respective reflector section 7 with the light transmitting part 6.

By virtue of the trough-shape of the light transmitting part 6, light from lamp 5 is transmitted downwardly through the base of the light transmitting part and laterally through the sides 13 thereof. The angular position of reflector sections 7 with respect to the sides 13 of the light transmitting part 6 is such as to reflect the light transmitted thereto in a direction downwardly and outwardly. This will enhance the emitted light from the fixture in an attempt to compensate for the loss of the other two lamps which have been removed.

The light transmitting part 6 and the reflectors 7 are co-operatively supported in the frame 2 so as to be replaceable as a unit for the light transmitting panel 3 in the conventional embodiment of FIG. 1. In order to provide a secure assembly of the unit, it is a feature of the invention that both the light transmitting part 6 and the reflector sections 7 are respectively supported in the frame 2. Thereby the positioning of the light transmitting part 6 and the reflector sections 7 will be assured and will be resistant to vibrations and impacts to which the normal ceiling fixture is subjected.

Figure 4:
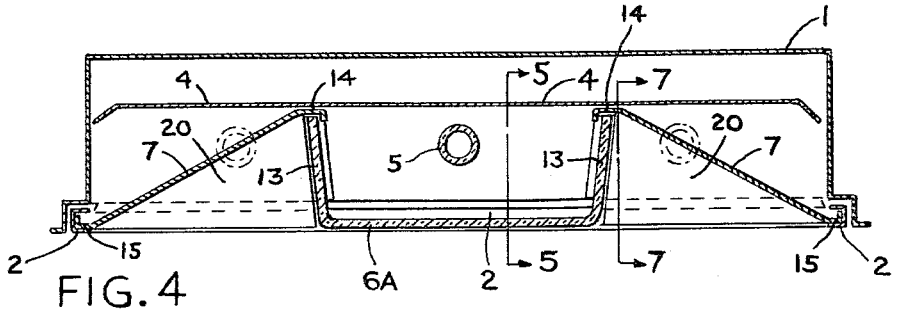
FIG. 4 is a transverse section taken through the fixture in FIG. 3.
Figure 7:
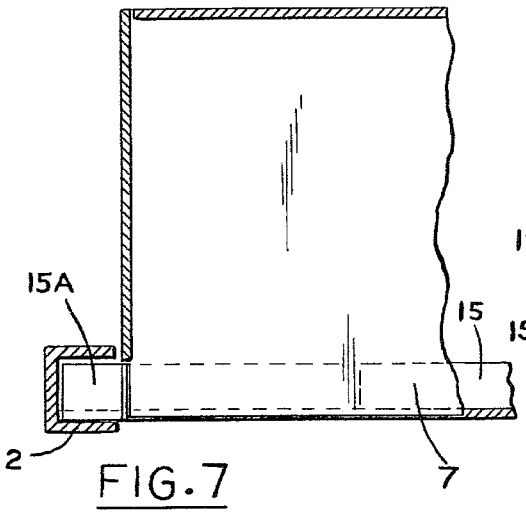
FIG. 7 is a sectional view taken along line 7—7 in FIG. 4.

As seen in FIG. 4, the reflector sections 7 have bent side edges 15 extending along the entire length thereof which are engaged in the laterally extending sides of frame 2. The bent edges 15 extend beyond the edge of the reflector 7 as shown at 15A and FIG. 7 and engage in the ends of the door frame 2 as shown in FIG. 7. Thereby, the bent edge 15 not only engages in the side of door frame 2 but also in the opposite ends thereof.

The light transmitting part 6 is formed with a lip 16 which extends along the transverse edge of the light transmitting part and is aligned with the lip 15A of the bent edge 15 of the reflector sections 7. The lip 16 is engaged in the end of door frame 2 as shown in FIG. 5.

In this way, both the light transmitting part 6 and the reflector sections 7 are secured in the door frame 2.

Figure 5:
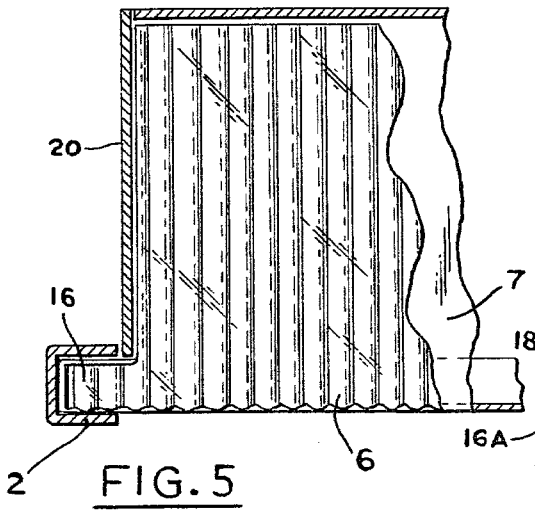
FIG. 5 is a sectional view taken along line 5—5 in FIG. 4.

FIGS. 5 and 7 show the engagement of the light transmitting part 6 and the reflector section 7 at the left end of the assembly and the construction at the right end will be identical.

Figure 6:
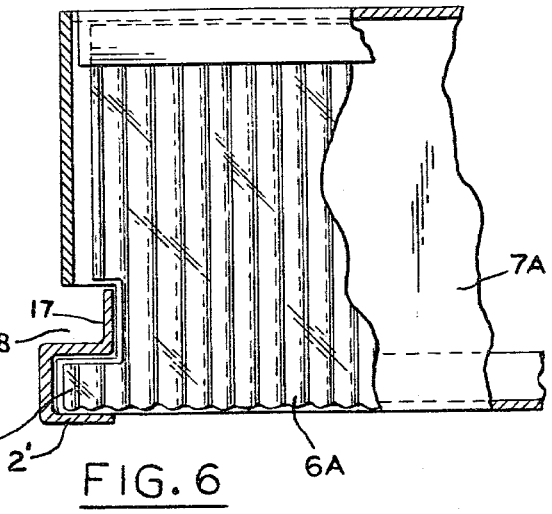
FIG. 6 is a sectional view similar to that in FIG. 5 of a modified embodiment.
Figure 8:
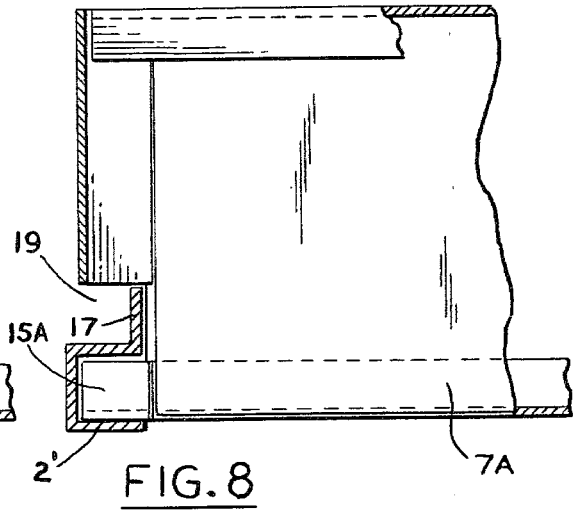
FIG. 8 is a sectional view similar to FIG. 7 of a modified embodiment.

FIGS. 6 and 8 show modifications respectively of the light transmitting part and the reflector sections.

In FIG. 6 it is seen that the door frame 2' is modified to provide a vertical return edge 17. The light transmitting part 6A is provided with a notch 18 to form a lip 16A which is engaged within the channel of door frame 2'. The vertical return edge 17 is accommodated in notch 18.

FIG. 8 shows the corresponding arrangement of reflector section 7A and herein a notch 19 is provided to from lip 15A which is engaged in door frame 2', the return edge 17 of the door frame being accommodated in notch 19.

The reflector sections can be formed with side pieces 20 to conceal the lateral inner surfaces of the ceiling fixture body 1. The reflector sections can be made of metal or of a metallized plastic to provide the reflective properties.

Although the invention has been described in conjunction with specific embodiments thereof, it will become apparent to those skilled in the art that numerous modifications can be made without departing from the scope and spirit of the invention as defined in the appended claims.

Thus, for example, although the described embodiments disclose the retention of a single fluorescent lamp it would be obvious to retain a plurality of fluorescent lamps.

What is claimed is:

1. In a ceiling light fixture having a fixture body adapted for receiving a plurality of replaceable fluorescent lamps, and a light transmitting panel detachably supported by the fixture body for covering the fixture body, the improvement wherein said light transmitting panel includes a light transmitting part partially covering the fixture body and partially surrounding at least one of said fluorescent lamps for permitting light passage therefrom while leaving exposed a remaining portion of the fixture body at which a plurality of fluorescent lamps could have been installed, shielding means for covering said remaining portion of the fixture body; said shielding means being operatively positioned in facing relation to said light transmitting part to reflect downwardly light transmitted thereto, and door frame means detachably engageable with the fixture body and operatively engaging both said light transmitting part and said shielding means to mount the light transmitting part and the shielding means as a unit on the fixture body when the door frame means is engaged therewith.

2. The improvement as claimed in claim 1 wherein said shielding means includes a light-reflective surface.

3. The improvement as claimed in claim 1 wherein said light transmitting part has a trough shape.

4. The improvement as claimed in claim 1 wherein said fixture body includes a frame for receiving said door frame means therefor, said shielding means including bent edges for engaging said light transmitting part to minimize light leakage therebetween.

5. The improvement as claimed in claim 3 wherein said shielding means comprises two reflector sections respectively engaging the light transmitting part on opposite sides thereof.

6. The improvement as claimed in claim 5 wherein said door frame means comprises a door frame including a channel receiving said reflector sections and said light transmitting part.

7. The improvement as claimed in claim 6 wherein said light transmitting part has ends each with a projecting lip engaging in said door frame.

8. The improvement as claimed in claim 6 wherein said light transmitting part has ends each with a notch to form a lip engaging in said door frame.

9. The improvement as claimed in claim 6 wherein said reflector sections have bent side edges remote from the light transmitting part, said bent side edges engaging said door frame.

10. The improvement as claimed in claim 9 wherein said reflector sections have ends at which said bent side edges project laterally to form projecting lips, said light transmitting part having ends each with a projecting lip aligned with a respective said lip of the reflector sections, said door frame engaging the aligned lips.

11. The improvement as claimed in claim 9 wherein said reflector sections have ends provided with notches to form projecting lips at said ends, said light transmitting part having ends with notches forming projecting lips aligned with the lips on the reflector sections, said door frame engaging said aligned lips.

12. The improvement as claimed in claim 5 wherein said reflector sections are made of metal.

13. The improvement as claimed in claim 1 wherein the fixture body has an open mouth with means thereat for releasably engaging said door frame means and said unit therewith.

14. The improvement as claimed in claim 13 wherein said door frame means is disposed in a plane.

15. The improvement as claimed in claim 1 wherein the fixture body has opposite ends and said shielding means includes opposite end panels for covering the opposite ends of the fixture body.

16. A method of converting a ceiling light fixture, adapted for receiving a plurality of removable fluorescent lamps and having a replaceable door with a light transmitting cover therefor, into a fixture with a reduced number of lamps, said method comprising mounting a light transmitting panel in replacement for said door and which encloses at least one fluorescent lamp but less than said plurality of fluorescent lamps to leave an exposed remaining portion of the fixture where the other now unenclosed lamps would have been, transmitting light through said light transmitting part downwardly and laterally from said at least one fluorescent lamp, covering said remaining portion of the fixture with two shielding portions engaging said light transmitting part, and reflecting light from said shielding portions which is transmitted thereto by said light transmitting part.

17. A method as claimed in claim 16 comprising engaging said light transmitting part and said shielding portion as a unit in a door frame which is mountable in the fixture body.

18. A method as claimed in claim 16 comprising releasably engaging said door frame in said fixture body so that said light transmitting part and shielding portion are releasable as said unit to provide access to said at least one lamp enclosed by the light transmitting part.

* * * * *